US006312587B1

(12) United States Patent
Ohno et al.

(10) Patent No.: US 6,312,587 B1
(45) Date of Patent: Nov. 6, 2001

(54) METHOD OF TREATING POLYCHLORINATED AROMATIC COMPOUND

(75) Inventors: Masayuki Ohno, Habikino; Hisasi Kaneda, Osaka, both of (JP)

(73) Assignees: Kansai Tech Corporation; The Kansai Electric Power Co., Inc., both of Osaka (JP)

( * ) Notice: Subject to any disclaimer, the term of this patent is extended or adjusted under 35 U.S.C. 154(b) by 1124 days.

(21) Appl. No.: 08/789,160

(22) Filed: Jan. 24, 1997

Related U.S. Application Data

(63) Continuation of application No. 08/425,629, filed on Apr. 20, 1995, now abandoned.

(30) Foreign Application Priority Data

Jun. 30, 1994 (JP) ..... 6-149595

(51) Int. Cl.[7] ..... C10G 29/00; A62D 3/00

(52) U.S. Cl. ..... 208/262.5; 208/262.1; 588/207; 588/209

(58) Field of Search ..... 208/262.1, 262.5; 588/207, 209

(56) References Cited

U.S. PATENT DOCUMENTS 4,327,027 * 4/1982 Howard et al. ..... 588/207
4,447,541 * 5/1984 Peterson ..... 208/262.5
4,471,143 * 9/1984 Pytlewski et al. ..... 588/901
4,532,028 * 7/1985 Peterson ..... 588/207
4,574,013 * 3/1986 Peterson ..... 134/2
4,776,947 * 10/1988 Streck et al. ..... 208/262.1
4,839,042 * 6/1989 Tumiatti et al. ..... 208/262.5
4,910,353 * 3/1990 Siegman ..... 570/204
5,132,006 * 7/1992 Neumann et al. ..... 208/262.1
5,174,893 * 12/1992 Halpern et al. ..... 208/262.5
5,220,109 * 6/1993 Commandeur et al. ..... 588/209
5,276,250 * 1/1994 Hagenmaier et al. ..... 588/209
5,290,432 * 3/1994 Friedman et al. ..... 588/207
5,387,734 * 2/1995 Hagenmaier et al. ..... 588/209

* cited by examiner

*Primary Examiner*—Walter D. Griffin
(74) *Attorney, Agent, or Firm*—Flynn, Thiel, Boutell & Tanis, P.C.

(57) ABSTRACT

A method of treating a polychlorinated aromatic compound or a hydrocarbon oil containing a polychlorinated aromatic compound involves the step of heating while stirring the polychlorinated aromatic compound or the hydrocarbon oil containing the polychlorinated aromatic compound in the presence an alkali metal tert-butoxide as a reactant to remove chlorine from the polychlorinated aromatic compound and provide a post-reaction system with no chlorine.

4 Claims, No Drawings

METHOD OF TREATING POLYCHLORINATED AROMATIC COMPOUND

This application is a continuation of U.S. Ser. No. 08/425,629, filed Apr. 20, 1995, now abandoned.

BACKGROUND OF THE INVENTION

1. Field of the Invention

The present invention relates to dechlorination of polychlorinated aromatic compounds that are environmental pollutants. More particularly, the present invention relates to a method of treating polychlorobiphenyl contained in a hydrocarbon oil, especially in an insulating oil used in a transformer.

The present invention also relates to a method of treating a polychlorinated aromatic compound which is advantageous by antipollution considerations. This method allows the removal of chlorine from polychlorobiphenyl contained in an insulating oil. The resultant reaction product is thus an organic compound with no chlorine content, and may be disposed of as an industrial waste and a municipal waste. In addition, the oil after treatment may be recycled as a harmless hydrocarbon oil.

2. Description of the Prior Art

Polychlorinated aromatic compounds such as polychlorobiphenyl (PCB) are known as environmental pollutants. Such compounds are contained in, for example, insulating (hydrocarbon) oils used in a transformer. The insulating oil polluted with the polychlorinated aromatic compound is recovered and stored under present technical conditions.

Some articles disclose the decomposition of PCB by means of heating the composition (such as oil) containing PCB at a high temperature. This method, however, requires special facilities and some supplementary facilities to generate a high temperature. Such facilities may also be required to purify the exhaust gas because there is a possibility of causing incomplete decomposition of PCB. Alternatively, the polychlorinated aromatic compound, such as PCB-contained in the hydrocarbon oils may be removed therefrom through chemical decomposition. In this method, the hydrocarbon oil is stirred while heating along with polyethylene glycol and an alkali metal hydroxide. This technique is disclosed in, for example, Japanese Patent Laid-Open Nos. 49-126651 and 60-114278.

It is known that the chlorine of PCB in these methods remains in the polyethylene glycol layer as a reaction product which has a bound chlorine (organic chlorine compound) rather than being removed completely.

In other words, it is only possible to remove PCB from the hydrocarbon oil but another problem occurs on disposal of the organic chlorine compound remained in the polyethylene glycol layer. In addition, typical chemical methods of removing PCB require a solvent or solvents added to the composition from which PCB is to be removed for decomposing the latter. This means that the treating process becomes complicated due to the necessary steps of separating and recovering the hydrocarbon oil and the solvent after the reaction, and of treating the used solvent.

As mentioned above, the known methods are insufficient by practical considerations because PCB is not completely dechlorinated, even by using the specific facilities and/or complicated treating process.

Accordingly, an object of the present invention is to provide a safe, effective method of dechlorinating polychlorinated aromatic compounds that are environmental pollutants.

Another object of the present invention is to provide a method of removing polychlorobiphenyl contained in a hydrocarbon oil, especially in an insulating oil used in a transformer.

Yet another object of the present invention is to provide a method of removing chlorine from polychlorobiphenyl to achieve complete removal of an organic chlorine compound from the entire system after reaction.

SUMMARY OF THE INVENTION

The present inventors had made tremendous studies about the above mentioned problems. As a result, it has revealed that the bound chlorine in the polychlorinated aromatic compound can be removed almost completely as an inorganic chlorine by using an alkali metal tert-butoxide as a reactant. The present invention was thus completed.

More specifically, the present invention is a method of treating a polychlorinated aromatic compound or a hydrocarbon oil containing a polychlorinated aromatic compound comprising the step of: heating while stirring the polychlorinated aromatic compound or the hydrocarbon oil containing the polychlorinated aromatic compound with an alkali metal tert-butoxide used as a reactant to remove chlorine from the polychlorinated aromatic compound, the alkali metal tert-butoxide being represented by the general formula:

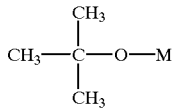

wherein M is an alkali metal, to provide a post-reaction system with no chlorine content.

In the method of treating a polychlorinated aromatic compound disclosed above, the alkali metal tert-butoxide may be potassium tert-butoxide.

In the method of treating a polychlorinated aromatic compound disclosed above, the polychlorinated aromatic compound may be polychlorobiphenyl.

In the method of treating a polychlorinated aromatic compound disclosed above, the treatment may be conducted without a solvent.

In the method of treating a polychlorinated aromatic compound disclosed above, the treatment may be conducted in the presence of a single solvent or a mixture of solvents.

The polychlorinated aromatic compounds applicable to the present invention include polychlorobiphenyl (PCB), dioxin, polychlorobenzene, and dichlorodiphenyl trichloroethane (DDT). Of these, polychlorobiphenyl can be treated most advantageously.

The polychlorinated aromatic compound alone may be treated by the present invention. In addition, the method of the present invention can be applied to a mixture containing the compound(s). The method of the present invention is particularly applicable to a hydrocarbon oil, such as an insulating oil, containing the polychlorobiphenyl. There is no limitation on the concentration of the polychlorobiphenyl in the hydrocarbon oil. The present invention can be applied to a hydrocarbon oil containing the polychlorobiphenyl in an extremely small amount, as well as to the polychlorobiphenyl alone.

Examples of the alkali metal tert-butoxide used in the present invention include lithium tert-butoxide, sodium tert-butoxide, and potassium tert-butoxide. Of these, potassium tert-butoxide is preferable. The amount of the alkali metal tert-butoxide used is preferably 10 times or more, by molar amount, relative to the amount of the polychlorinated aromatic compound.

The method of treating the polychlorinated aromatic compound according to the present invention may be conducted without a solvent. With this method, the entire reaction system becomes simple, eliminating the necessity of fully analyzing the chlorinated aromatic compound(s) remaining in the solvent. In addition, this method also eliminates the necessity of providing measures to treat and reuse these solvents. The dechlorination according to the present invention can thus be conducted completely without using any solvent, as will be apparent from the examples described below.

Alternatively, a solvent or solvents may be used in the present invention. The solvent(s) used may be polar and/or non-polar one(s). Examples of such solvents include, but are not limited to, polyalkylene glycol; monoalkyl ether of polyalkylene glycol; dialkyl ether of polyalkylene glycol; aromatic hydrocarbons; non-aromatic hydrocarbons; sulfoxides; amines; alcohols; ketones; ethers; cyclic ethers; amide; nitrogen-containing ring aromatic compounds; nitriles; and phosphoroamides. These solvents may be used as an anhidlide or, as a case may be, a hidlide.

The polyalkylene glycol used is represented by the general formula:

$$HO—[R—O—]_nH,$$

wherein n is from 1 to 30, R is a linear or branched alkylene group having from 2 to 7 carbon atoms. More specifically, the polyalkylene glycol may be, for example, ethylene glycol, diethylene glycol, triethylene glycol, tetraethylene glycol, polyethylene glycol, propylene glycol, or butylene glycol.

The monoalkyl ether of polyalkylene glycol is represented by the general formula:

$$HO—[R—O—]_nR^1,$$

wherein n is from 1 to 30, R is a linear or branched alkylene group having from 2 to 7 carbon atoms, and $R^1$ is an alkyl group having from 1 to 5 carbon atoms. More specifically, the monoalkyl ether of polyalkylene glycol may be, for example, ethylene glycol, monomethyl ether, ethylene glycol monoethyl ether, diethylene glycol monomethyl ether, diethylene glycol monoethyl ether, triethylene glycol monomethyl ether, triethylene glycol monoethyl ether, tetraethylene glycol monomethyl ether, tetraethylene monoethyl ether, polyethylene glycol monomethyl glycol ether, propylene glycol monoalkyl ether, butylene glycol monoalkyl ether, and polyethylene glycol monoethyl ether.

The dialkyl ether of polyalkylene glycol is represented by the general formula:

$$R^1O—[R—O—]_nR^2,$$

wherein n is from 1 to 30, R is a linear or branched alkylene group having from 2 to 7 carbon atoms, and $R^1$ and $R^2$ are each an alkyl group having from 1 to 5 carbon atoms. More specifically, the dialkyl ether of polyalkylene glycol may be, for example, ethylene glycol dimethyl ether, ethylene glycol diethyl ether, diethylene glycol dimethyl ether, diethylene glycol diethyl ether, triethylene glycol dimethyl ether, triethylene glycol diethyl ether, tetraethylene glycol dimethyl ether, tetraethylene glycol diethyl ether, polyethylene-glycol dimethyl ether, and polyethylene glycol diethyl ether. Of these, the solvent that is preferable in view of easy availability and low price is a dimethyl ether such as ethylene glycol dimethyl ether, diethylene glycol dimethyl ether, triethylene glycol dimethyl ether, tetraethylene glycol dimethyl ether, and polyethylene glycol dimethyl ether.

The aromatic hydrocarbon may be, for example, benzene or methyl benzene while the non-aromatic hydrocarbon may be, for example, cyclohexane, pentane, or hexane. The sulfoxides may be dimethyl sulfoxide or sulfolane. The amine may be ethylene diamine while the alcohol may be methanol or ethanol. The ketone may be acetone while the ether may be methyl ether. The cyclic ether may be tetrahydrofuran or dioxane, while the amide may be acetoamide, dimethyl acetoamide, formamide, or dimethyl formamide. The nitrogen-containing ring aromatic compound may be N-methyl pyrrolidone, dimethylpyridine, or 1,3-dimethyl-1-imidazolidinone. The nitrile may be acetonitrile while the phosphoroamide may be hexamethyl phosphotriamide.

While not being specifically limited, an amount of the solvent used is preferably from 0 to 9 (volumetric ratio) relative to the hydrocarbon oil containing the polychlorinated aromatic compound or to the polychlorinated aromatic compound alone.

A reaction temperature is typically from 100° C., and preferably to 300° C. to prevent production of thermal degraded products.

By increasing the reaction temperature, it is possible to reduce the reaction time required for achieving complete dechlorination of the polychlorobiphenyl. The desired reaction time depends on the concentration of the polychlorobiphenyl. However, the reaction time is typically up to 60 minutes at a reaction temperature of 180° C. or higher and at a concentration of around 250 ppm.

The oxygen in the air has no significant effects on the reaction of the present invention. However, it is preferable that the reaction of the present invention is conducted in an atmosphere of an inert gas such as nitrogen to prevent the hydrocarbon oil from being oxidized by oxygen, along with the safety considerations.

An operational method during reaction may be any suitable one. For example, the alkali metal tert-butoxide may be mixed directly with the hydrocarbon oil containing polychlorobiphenyl when the operation is conducted without a solvent. On the other hand, when the operation is conducted in the presence of a solvent, the alkali metal tert-butoxide may be dissolved while stirring in a solvent at a predetermined temperature, to which a hydrocarbon oil containing polychlorobiphenyl is added. Alternatively, a solvent, an alkali metal tert-butoxide, and a hydrocarbon oil containing polychlorobiphenyl may be mixed.

The reaction may be conducted batchwise while stirring the mixture at a predetermined temperature for a predetermined time. Alternatively, a continuous reaction may be made in which an alkali metal tert-butoxide or a hydrocarbon oil containing polychlorobiphenyl to which the alkali metal tert-butoxide is dissolved has been heated to a predetermined reaction temperature and is then mixed continuously.

The reaction product is readily separated into an oily phase and a water phase by means of cooling it to a room temperature immediately after the reaction and then adding water. As mentioned above, the oily layer contains no harmful polychlorinated aromatic compound. Accordingly, the oily layer may be recycled as it is and used as an insulating oil. The chlorine removed as a result of the reaction is present in the water layer in the form of an ionized alkali metal chloride. The alkali metal chloride may be recovered. Alternatively, this harmless alkali metal chloride may be disposed of as it is in the form of an aqueous solution.

The solvent, if used, may be recycled by means of adding water to the reaction product to separate the upper oily layer from the lower layer and then separating the lower layer into water and the solvent through distillation.

As mentioned above, the treating method of the present invention is advantageous from the point that the treated product after the reaction is harmless. This improves cost efficiency of the treatment. In addition, the entire system may be provided as a closed system. Such a closed system is optimum to treat harmful or toxic compound(s).

In the method of the present invention, chlorine of the polychlorobiphenyl contained in the hydrocarbon oil is removed as an inorganic chlorine. The reaction product thus contains no chlorine after the reaction. This effect of the present invention cannot be expected from any known methods.

The present invention is also directed to reuse of the hydrocarbon oil from which PCB is removed, and to provide a safe, cost-effective treatment method. With this respect, the hydrocarbon oil is separated from the reaction product obtained by the present method and is recovered for recycling.

DETAILED DESCRIPTION OF THE INVENTION

Description will now be made to show that the hydrocarbon oil treated through the method of the present invention contains no polychlorobiphenyl and the reaction product of the present method contains no chlorine.

The present invention is described more in detail in conjunction with a set of examples. However, it is noted that the present invention is not limited to those specific examples.

EXAMPLE 1

Into a 1000 ml four-neck stainless separable flask equipped with a stirrer, a reflux condenser, a nitrogen gas inlet adapter, and a thermometer were added 100 g (containing 16.5 mg of chlorine; measured by the burning-coulometric titration) of an insulating oil containing 26 mg of an equivalent weight mixture of Kanechlor KC-300, 400, 500, and 600 (Trademark), and 1.0 g of potassium tert-butoxide. The content of the flask was reacted while stirring and bubbling of nitrogen at a reaction temperature of 220° C. for 10 minutes.

After the reaction, the following procedure was conducted to quantitatively analyze the polychlorobiphenyl, the organic chlorine compound(s), and chlorine separated from the polychlorobiphenyl.

The reaction mixture was cooled to room temperature and 200 ml of 1%-sulfuric acid solution was added. The mixture was shaken and passed through a separating funnel to separate the oily layer from the water layer.

To determine the concentration of the polychlorobiphenyl, 20 g of the oily layer was weighed and then 20 ml of n-hexane was added. The mixture was twice subjected to partitioning contact operation with a dimethyl sulfoxide:n-hexane (120 ml:20 ml) solution to form a dimethyl sulfoxide layer. 3N-HCl (30 ml) was added to this dimethyl sulfoxide layer and then extracted with 200 ml of n-hexane. This n-hexane solution was concentrated to 10 ml by using a Guderna-Danish Evaporative concentrator. The resultant solution was washed with 2 ml of fuming sulfuric acid and rinsed with water. The solution was then concentrated to 3 ml in a nitrogen flow for subsequent analysis for PCB through an analytical method by using a gas chromatograph mass spectrometer.

The reacted oil was subjected to measurement for the amount of residual organic chlorine compound by means of the burning-coulometric titration. For the water layer, organic compounds were extracted with 100 ml of diethyl ether. The water layer was adjusted with purified water to the total amount of 500 ml and then subjected to the quantitative analysis of chlorine ions by means of titration with a 1/100 N-silver nitrate solution.

As a result of this analysis, no PCB was detected in the insulating oil after the reaction (lower detection limit was 10 ppb). In addition, no organic chlorine compound was detected in the insulating oil after the reaction (lower detection limit was 1.0 ppm). The amount of the chlorine ions detected in the water layer was 17.1 mg (dechlorination ratio of 100%).

As mentioned above, the reaction solution was separated into the oily layer and the water layer for analysis of the chlorine content. As a result, no chlorine was detected in these layers. This indicates that no chlorine was contained in the entire system after reaction.

EXAMPLE 2

Example 1 was repeated to conduct the reaction under the same conditions except that the reaction temperature was 180° C. and the reaction time was 60 minutes. After the reaction, quantitative analysis was conducted for PCB, the organic chlorine compound and the chlorine ions. As a result, no PCB was detected (lower detection limit was 0.01 ppm). In addition, no organic chlorine compound was detected in the insulating oil after the reaction (lowest detection limit was 1.0 ppm). The amount of the chlorine ions detected in the water layer was 16.8 mg (dechlorination ratio of 100%).

Comparative Example 1

Example 2 was repeated to conduct the reaction under the same conditions except that potassium tert-butoxide was replaced by 2.0 g of potassium hydroxide and 100 g of polyethylene glycol (average molecular weight of 400). After the reaction, quantitative analysis was conducted for PCB, the organic chlorine compound and the chlorine ions in the same manner as in Example 1. As a result of this analysis, the PCB concentration in the insulating oil was 14.7 ppm. The concentration of the organic chlorine compound in the insulating oil after the reaction was 92 ppm. The amount of the chlorine ions detected in the water layer was 6.7 mg (dechlorination ratio of 40.6%).

Comparative Example 2

Example 2 was repeated to conduct the reaction under the same conditions except that potassium tert-butoxide was replaced by 2.0 g of sodium methylate. After the reaction, quantitative analysis was conducted for PCB, the organic chlorine compound and the chlorine ions in the same manner as in Example 1. As a result of this analysis, the PCB concentration in the insulating oil was 213 ppm. The concentration of the organic chlorine compound in the insulating oil after the reaction was 147 ppm. No chlorine were detected in the water layer.

Comparative Example 3

Example 2 was repeated to conduct the reaction under the same conditions except that potassium tert-butoxide was replaced by 2.0 g of sodium ethylate. After the reaction, quantitative analysis was conducted for PCB, the organic chlorine compound and the chlorine ions in the same manner as in Example 1. As a result of this analysis, the PCB concentration in the insulating oil was 245 ppm. The concentration of the organic chlorine compound in the insulating oil after the reaction was 159 ppm. No chlorine ions detected in the water layer.

Results of the Examples and Comparative Examples are given in Table 1.

TABLE 1

| | Example 1 | Example 2 | Comparative Example 1 | Comparative Example 2 | Comparative Example 3 |
|---|---|---|---|---|---|
| Insulating Oil (g) | 100 | 100 | 100 | 100 | 100 |
| PCB Concentration (ppm) | 263 | 263 | 263 | 263 | 263 |
| Chlorine Amount (mg) | 16.5 | 16.5 | 16.5 | 16.5 | 16.5 |
| Reactant (g) | t-BuOk 1.0 | t-BuOk 1.0 | KOH 2.0 | Na—OMe 2.0 | Na—OEt 2.0 |
| Solvent (g) | — | — | PEG400 100 | — | — |
| Reaction Temperature (° C.) | 220 | 180 | 180 | 180 | 180 |
| Reaction Time (min.) | 10 | 60 | 60 | 60 | 60 |
| Residual PCB (ppm) | ≦0.01 | ≦0.01 | 14.7 | 213 | 245 |
| Separated Chlorine Amount (mg) | 17.1 | 16.8 | 6.7 | Not detected (≦1) | Not detected (≦1) |

As mentioned above, the present invention is an effective method of dechlorinating polychlorinated aromatic compounds that are known as environmental pollutants. This method can be applied to remove polychlorobiphenyl contained in a hydrocarbon oil, especially in an insulating oil used in a transformer. The treated hydrocarbon oil may be recycled or reused.

While the present invention has thus been described in conjunction with a specific set of examples, it is noted that various changes and modifications can be made by those skilled in the art without departing from the scope and spirit of the present invention.

What is claimed is:

1. A method of treating a polychlorinated aromatic compound or a hydrocarbon oil containing a polychlorinated aromatic compound comprising the steps of:

heating and stirring the polychlorinated aromatic compound or hydrocarbon oil containing the polychlorinated aromatic compound and adding potassium tert-butoxide to said polychlorinated aromatic compound or hydrocarbon oil containing said polychlorinated aromatic compound to conduct a reaction therewith in the absence of a solvent and at a temperature of from 100 to 300° C. and remove chlorine from said polychlorinated aromatic compound.

2. The method of claim 1, wherein the polychlorinated aromatic compound comprises polychlorobiphenyl.

3. A method of treating a polychlorinated aromatic compound or a hydrocarbon oil containing a polychlorinated aromatic compound comprising the steps of:

heating and stirring the polychlorinated aromatic compound or hydrocarbon oil containing the polychlorinated aromatic compound and adding potassium tert-butoxide to said polychlorinated aromatic compound or hydrocarbon oil containing said polychlorinated aromatic compound to conduct a reaction therewith in the absence of a solvent and at a temperature from 100 to 180° C. and remove chlorine from said polychlorinated aromatic compound.

4. The method of claim 3, wherein said polychlorinated aromatic compound comprises polychlorobiphenyl.

* * * * *